US011732703B2

(12) United States Patent
Yatsu

(10) Patent No.: US 11,732,703 B2
(45) Date of Patent: Aug. 22, 2023

(54) CRYOPUMP AND REGENERATION METHOD OF CRYOPUMP

(71) Applicant: SUMITOMO HEAVY INDUSTRIES, LTD., Tokyo (JP)

(72) Inventor: Takahiro Yatsu, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 30 days.

(21) Appl. No.: 17/490,642

(22) Filed: Sep. 30, 2021

(65) Prior Publication Data

US 2022/0099076 A1 Mar. 31, 2022

(30) Foreign Application Priority Data

Sep. 30, 2020 (JP) ..... 2020-164528

(51) Int. Cl.
*F04B 37/08* (2006.01)

(52) U.S. Cl.
CPC ..... *F04B 37/085* (2013.01); *Y10S 417/901* (2013.01)

(58) Field of Classification Search
CPC ..... F04B 37/085; F04B 37/08; Y10S 417/901
See application file for complete search history.

(56) References Cited

U.S. PATENT DOCUMENTS 5,400,604 A * 3/1995 Hafner ..... F04B 37/08 62/55.5
5,465,584 A 11/1995 Mattern-Klosson et al.
5,974,809 A * 11/1999 Wooster ..... F04B 37/08 62/55.5
9,186,601 B2 * 11/2015 Longsworth ..... B01D 8/00

FOREIGN PATENT DOCUMENTS

CN 101094710 A 12/2007
JP H09-126125 A 5/1997
JP 2000-274356 A 10/2000
JP 2007-309184 A 11/2007

* cited by examiner

*Primary Examiner* — Lionel Nouketcha
(74) *Attorney, Agent, or Firm* — Michael Best & Friedrich LLP

(57) ABSTRACT

There is provided a cryopump including a cryocooler, a cryopanel that is cooled by the cryocooler, a cryopump container that includes a container body, which accommodates the cryopanel, and a cryocooler accommodating tube of which one end is coupled to the container body and the other end is fixed to the cryocooler and into which the cryocooler is inserted, a vent valve for exhausting a fluid from the cryopump container, a first exhaust passage that includes a first exhaust port provided in the container body, is disposed outside the cryopump container, and connects the first exhaust port to the vent valve, and a second exhaust passage that includes a second exhaust port provided in the cryocooler accommodating tube, connects the second exhaust port to the vent valve, and merges with the first exhaust passage between the first exhaust port and the vent valve.

9 Claims, 8 Drawing Sheets

CRYOPUMP AND REGENERATION METHOD OF CRYOPUMP

RELATED APPLICATIONS

The content of Japanese Patent Application No. 2020-164528, on the basis of which priority benefits are claimed in an accompanying application data sheet, is in its entirety incorporated herein by reference.

BACKGROUND

Technical Field

Certain embodiments of the present invention relate to a cryopump and a regeneration method of a cryopump.

Description of Related Art

A cryopump is a vacuum pump that captures gas molecules through condensation and/or adsorption on a cryopanel cooled to a cryogenic temperature and exhausts the gas molecules. The cryopump is used in general in order to realize a clean vacuum environment required for semiconductor circuit manufacturing processes. Since the cryopump is a so-called gas accumulating type vacuum pump, regeneration in which the captured gas is periodically exhausted to the outside is required.

SUMMARY

According to an aspect of the present invention, there is provided a cryopump including a cryocooler, a cryopanel that is cooled by the cryocooler, a cryopump container that includes a container body, which accommodates the cryopanel, and a cryocooler accommodating tube of which one end is coupled to the container body and the other end is fixed to the cryocooler and into which the cryocooler is inserted, a vent valve for exhausting a fluid from the cryopump container, a first exhaust passage that includes a first exhaust port provided in the container body, is disposed outside the cryopump container, and connects the first exhaust port to the vent valve, and a second exhaust passage that includes a second exhaust port provided in the cryocooler accommodating tube, connects the second exhaust port to the vent valve, and merges with the first exhaust passage between the first exhaust port and the vent valve.

According to another aspect of the present invention, there is provided a regeneration method of a cryopump. The method includes increasing a temperature of the cryopump to a melting point of a target gas, among gases captured in the cryopump, or a temperature exceeding the melting point and exhausting a liquefied product of the target gas to a vent valve from a container body of a cryopump container through a first exhaust passage and/or from a cryocooler accommodating tube of the cryopump container through a second exhaust passage. The first exhaust passage includes a first exhaust port provided in the container body and is disposed outside the cryopump container. The second exhaust passage includes a second exhaust port provided in the cryocooler accommodating tube and merges with the first exhaust pas sage between the first exhaust port and the vent valve.

According to still another aspect of the present invention, there is provided a cryopump including a cryocooler, a cryopanel that is cooled by the cryocooler, a cryopump container that includes a container body, which accommodates the cryopanel, and a cryocooler accommodating tube of which one end is coupled to the container body and the other end is fixed to the cryocooler and into which the cryocooler is inserted, a purge valve that is provided at the cryocooler accommodating tube and is for supplying purge gas to the cryopump container, a first exhaust passage that includes a first exhaust port provided in the container body, a second exhaust passage that includes a second exhaust port provided in the cryocooler accommodating tube, and a switching control valve that is capable of closing the second exhaust passage when the purge gas is supplied from the purge valve.

According to still another aspect of the present invention, there is provided a regeneration method of a cryopump. The method includes increasing a temperature of the cryopump to a melting point of a target gas, among gases captured in the cryopump, or a temperature exceeding the melting point, exhausting a liquefied product of the target gas to an outside of a cryopump container through a first exhaust port of a container body of the cryopump container and/or through a second exhaust port of a cryocooler accommodating tube of the cryopump container, and exhausting purge gas from an exhaust port, among the first exhaust port and the second exhaust port, which is farther from a purge valve, in a state where an exhaust port, among the first exhaust port and the second exhaust port, which is closer to the purge valve, is closed when the purge gas is supplied from the purge valve to the cryopump container.

Any combination of the components described above and a combination obtained by switching the components and expressions of the present invention between methods, devices, and systems are also effective as an embodiment of the present invention.

DETAILED DESCRIPTION

Depending on a process to which a cryopump is applied, a large amount of a so-called type 2 gas is accumulated in the cryopump in some cases. The type 2 gas refers to a gas such as argon and nitrogen captured through condensation on a cryopanel usually cooled to 20 K or lower. In this case, due to the temperature increase of the cryopump during regeneration, a large amount of the accumulated type 2 gas is liquefied and temporarily accumulates inside the cryopump in some cases. In a typical cryopump, the liquefied type 2 gas is vaporized through heating and is exhausted to the outside of the cryopump. Since it takes a considerable amount of time to vaporize a large amount of the liquefied gas, temperature increasing time or regeneration time of the cryopump becomes longer. In addition, the liquefied type 2 gas has an extremely low temperature and can cool a part in contact therewith in the cryopump. Accordingly, time taken for increasing the temperature of the cryopump becomes longer. In addition, there is also inconvenience that a large amount of dew condensation occurs on a cryopump outer surface when a cryopump container is cooled through contact with the liquefied type 2 gas.

It is desirable to shorten regeneration time of the cryopump.

Hereinafter, embodiments for carrying out the present invention will be described in detail with reference to the drawings. In the description and drawings, the same or equivalent components, members, and processing will be assigned with the same reference symbols, and redundant description thereof will be omitted as appropriate. The scales and shapes of illustrated parts are set for convenience in order to make the description easy to understand, and are not to be understood as limiting unless stated otherwise. The embodiments are merely examples and do not limit the scope of the present invention. All characteristics and combinations to be described in the embodiments are not necessarily essential to the invention.

Figure 1:
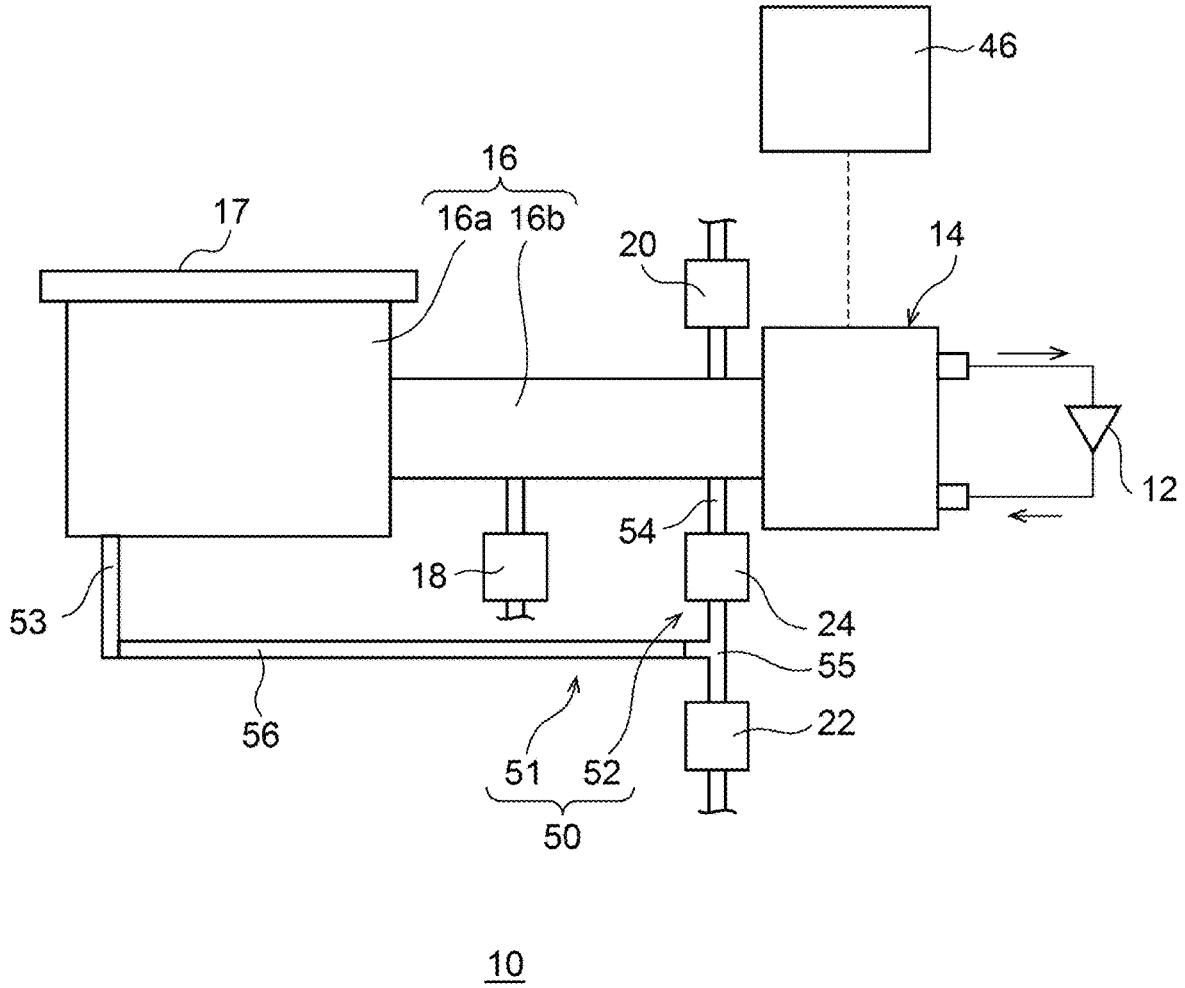
FIG. 1 schematically illustrates a cryopump according to an embodiment.
Figure 2:
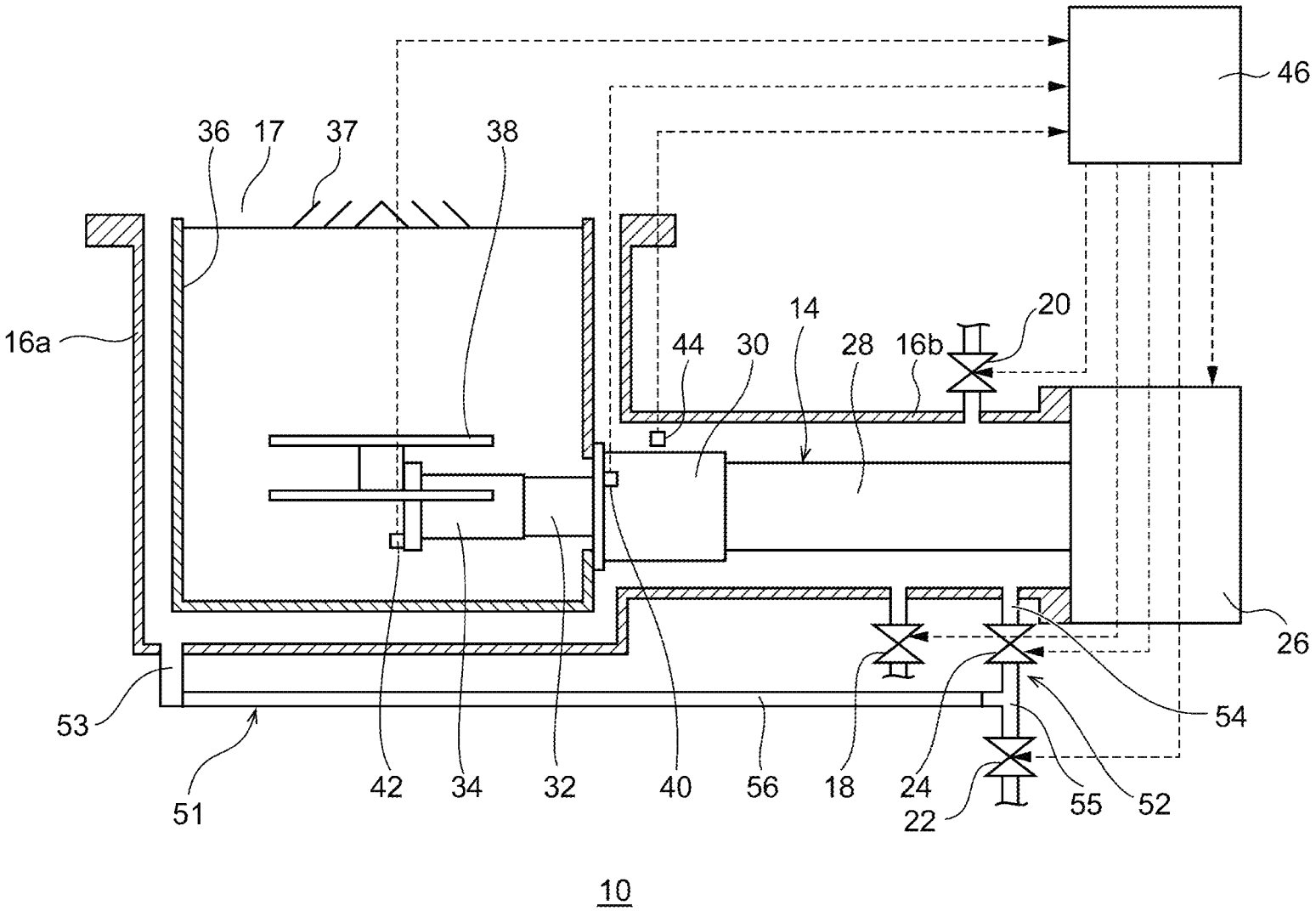
FIG. 2 schematically illustrates the cryopump according to the embodiment.

FIGS. 1 and 2 schematically illustrate a cryopump 10 according to an embodiment. FIG. 1 schematically illustrates the appearance of the cryopump 10. FIG. 2 schematically illustrates the internal structure of the cryopump 10. The cryopump 10 is attached to, for example, a vacuum chamber of an ion implanter, a sputtering device, a deposition device, or other vacuum process devices, and is used in order to increase a degree of vacuum inside the vacuum chamber to a level required for a desired vacuum process. For example, a high degree of vacuum of approximately $10^{-5}$ Pa to $10^{-8}$ Pa is realized in the vacuum chamber.

The cryopump 10 includes a compressor 12, a cryocooler 14, and a cryopump container 16. The cryopump container 16 includes a cryopump intake port 17. In addition, the cryopump 10 includes a rough valve 18, a purge valve 20, a vent valve 22, and a switching control valve 24, and the components are provided in the cryopump container 16.

The compressor 12 is configured to collect a refrigerant gas from the cryocooler 14, to pressurize the collected refrigerant gas, and to supply the refrigerant gas to the cryocooler 14 again. The cryocooler 14 is also called an expander or a cold head, and configures a cryocooler together with the compressor 12. A thermodynamic cycle, through which chill is generated, is configured by performing circulation of the refrigerant gas between the compressor 12 and the cryocooler 14 with an appropriate combination of pressure fluctuations and volume fluctuations of the refrigerant gas in the cryocooler 14, and thereby the cryocooler 14 can provide cryogenic temperature cooling. Although the refrigerant gas is usually a helium gas, other appropriate gases may be used. In order to facilitate understanding, a direction in which the refrigerant gas flows is shown with an arrow in FIG. 1. Although the cryocooler is, for example, a two-stage Gifford-McMahon (GM) cryocooler, the cryocooler may be a pulse tube cryocooler, a Stirling cryocooler, or other types of cryocoolers.

As illustrated in FIG. 2, the cryocooler 14 includes a room temperature portion 26, a first cylinder 28, a first cooling stage 30, a second cylinder 32, and a second cooling stage 34. The cryocooler 14 is configured to cool the first cooling stage 30 to a first cooling temperature and to cool the second cooling stage 34 to a second cooling temperature. The second cooling temperature is lower than the first cooling temperature. For example, the first cooling stage 30 is cooled to approximately 65 K to 120 K, preferably 80 K to 100 K, and the second cooling stage 34 is cooled to approximately 10 K to 20 K. The first cooling stage 30 and the second cooling stage 34 are also called a high temperature cooling stage and a low temperature cooling stage, respectively.

The first cylinder 28 connects the first cooling stage 30 to the room temperature portion 26, and accordingly, the first cooling stage 30 is structurally supported by the room temperature portion 26. The second cylinder 32 connects the second cooling stage 34 to the first cooling stage 30, and accordingly, the second cooling stage 34 is structurally supported by the first cooling stage 30. The first cylinder 28 and the second cylinder 32 extend coaxially along a radial direction. The room temperature portion 26, the first cylinder 28, the first cooling stage 30, the second cylinder 32, and the second cooling stage 34 are linearly arranged in a line in this order.

Ina case where the cryocooler 14 is a two-stage GM cryocooler, a first displacer and a second displacer (not illustrated) are reciprocally arranged inside the first cylinder 28 and the second cylinder 32, respectively. A first regenerator and a second regenerator (not illustrated) are incorporated in the first displacer and the second displacer, respectively. In addition, the room temperature portion 26 includes a drive mechanism (not illustrated) such as a motor for reciprocating the first displacer and the second displacer. The drive mechanism includes a flow path switching mechanism that switches between flow paths for a working gas (for example, helium) to periodically repeat supply and return of the working gas to and from the cryocooler 14.

In addition, the cryopump 10 includes a radiation shield 36 and a cryopanel 38. In order for the radiation shield 36 to provide a cryogenic temperature surface for protecting the cryopanel 38 from radiant heat from the outside of the cryopump 10 or the cryopump container 16, the radiation shield 36 is thermally coupled to the first cooling stage 30, and is cooled to the first cooling temperature.

The radiation shield 36 has, for example, a tubular shape, and is disposed to surround the cryopanel 38 and the second cooling stage 34. An end portion of the radiation shield 36 on a cryopump intake port 17 side is opened, a gas that enters through the cryopump intake port 17 from the outside of the cryopump 10 can be received in the radiation shield 36. An end portion of the radiation shield 36 on an opposite side to the cryopump intake port 17 is closed, includes an opening, or may be opened. There is a gap between the radiation shield 36 and the cryopanel 38, and the radiation shield 36 is not connected to the cryopanel 38. The radiation shield 36 is also not connected to the cryopump container 16.

An inlet baffle 37 fixed to an open end of the radiation shield 36 may be provided at the cryopump intake port 17. The inlet baffle 37 is cooled to the same temperature as the radiation shield 36, and can condense a so-called type 1 gas (a gas that condenses at a relatively high temperature, such as steam) on a surface thereof.

In order to provide a cryogenic temperature surface that condenses a type 2 gas (for example, a gas that condenses at a relatively low temperature, such as argon and nitrogen), the cryopanel 38 is thermally coupled to the second cooling stage 34, and is cooled to the second cooling temperature. In addition, in order to adsorb a type 3 gas (for example, a non-condensable gas, such as hydrogen), for example, activated carbon or another adsorbent is disposed on at least a part of a surface (for example, a surface on the opposite side to the cryopump intake port 17) of the cryopanel 38. A gas that enters the radiation shield 36 from the outside of the cryopump 10 through the cryopump intake port 17 is captured through condensation or adsorption on the cryopanel 38. Since various known configurations can be adopted as appropriate as forms that can be taken, such as the disposition and shape of the radiation shield 36 or the cryopanel 38, description thereof will not be made in detail.

The cryopump container 16 includes a container body 16*a* and a cryocooler accommodating tube 16*b*. The cryopump container 16 is a vacuum chamber that is designed to maintain vacuum during a vacuum pumping operation of the cryopump 10 and to withstand a pressure in the ambient environment (for example, the atmospheric pressure). The container body 16*a* has a tubular shape of which one end is provided with the cryopump intake port 17 and the other end is closed. The radiation shield 36 is accommodated in the container body 16*a*, and the cryopanel 38 is accommodated in the radiation shield 36 together with the second cooling stage 34 as described above. The cryocooler accommodating tube 16*b* has one end coupled to the container body 16*a* and the other end fixed to the room temperature portion 26 of the cryocooler 14. In the cryocooler accommodating tube 16*b*, the cryocooler 14 is inserted, and the first cylinder 28 is accommodated.

In the embodiment, the cryopump 10 is a so-called horizontal cryopump in which the cryocooler 14 is provided at a side portion of the container body 16*a*. A cryocooler insertion port is provided in the side portion of the container body 16*a*, and the cryocooler accommodating tube 16*b* is coupled to the side portion of the container body 16*a* at the cryocooler insertion port. Similarly, adjacent to the cryocooler insertion port of the container body 16*a*, a hole passing through the cryocooler 14 is provided also in a side portion of the radiation shield 36. The second cylinder 32 and the second cooling stage 34 of the cryocooler 14 are inserted into the radiation shield 36 through the holes, and the radiation shield 36 is thermally coupled to the first cooling stage 30 around the holes in the side portions.

The cryopump can be provided in various postures at the site of use. For example, the cryopump 10 can be provided in a horizontal posture to be illustrated, that is, a posture in which the cryopump intake port 17 faces upward. In this case, a bottom portion of the container body 16*a* is positioned below the cryopump intake port 17, and the cryocooler 14 extends in a horizontal direction.

The cryopump 10 includes a first temperature sensor 40 for measuring the temperature of the first cooling stage 30 and a second temperature sensor 42 for measuring the temperature of the second cooling stage 34. The first temperature sensor 40 is attached to the first cooling stage 30. The second temperature sensor 42 is attached to the second cooling stage 34. The first temperature sensor 40 can measure the temperature of the radiation shield 36, and output a first measured temperature signal indicating the measured temperature of the radiation shield 36. The second temperature sensor 42 can measure the temperature of the cryopanel 38, and output a second measured temperature signal indicating the measured temperature of the cryopanel 38. In addition, a pressure sensor 44 is provided inside the cryopump container 16. The pressure sensor 44 is provided in, for example, the cryocooler accommodating tube 16*b*, measures the internal pressure of the cryopump container 16, and can output a measured pressure signal indicating the measured pressure.

In addition, the cryopump 10 includes a controller 46 that controls the cryopump 10. The controller 46 may be integrally provided with the cryopump 10, or may be configured as a control device separately from the cryopump 10.

The controller 46 may control the cryocooler 14 based on the cooling temperature of the radiation shield 36 and/or the cryopanel 38 in the vacuum pumping operation of the cryopump 10. The controller 46 may be connected to the first temperature sensor 40 to receive a first measured temperature signal from the first temperature sensor 40 and be connected to the second temperature sensor 42 to receive a second measured temperature signal from the second temperature sensor 42.

In addition, in a regeneration operation of the cryopump 10, the controller 46 may control the cryocooler 14, the rough valve 18, the purge valve 20, the vent valve 22, and the switching control valve 24 based on a pressure in the cryopump container 16 (or if necessary, based on the temperature of the cryopanel 38 and a pressure in the cryopump container 16). The controller 46 may be connected to the pressure sensor 44 to receive a measured pressure signal from the pressure sensor 44.

The internal configuration of the controller 46 is realized by an element or a circuit including a CPU and a memory of a computer as a hardware configuration and is realized by a computer program as a software configuration, but is shown in the drawings as a functional block realized in cooperation therewith as appropriate. It is clear for those skilled in the art that the functional blocks can be realized in various manners in combination with hardware and software.

For example, the controller 46 can be mounted in combination with a processor (hardware) such as a central processing unit (CPU) and a microcomputer and a software program executed by the processor (hardware). The software program may be a computer program for causing the controller 46 to execute the regeneration of the cryopump 10.

The rough valve 18 is provided at the cryopump container 16, for example, the cryocooler accommodating tube 16*b*. The rough valve 18 is connected to a rough pump (not illustrated) provided outside the cryopump 10. The rough pump is a vacuum pump for evacuating the cryopump 10 to the operation starting pressure. The cryopump container 16 communicates with the rough pump when the rough valve 18 is opened through control by the controller 46. The cryopump container 16 is cut off from the rough pump when the rough valve 18 is closed. By opening the rough valve 18 and operating the rough pump, the cryopump 10 can be decompressed.

The purge valve 20 is provided at the cryopump container 16, for example, the cryocooler accommodating tube 16*b*. The purge valve 20 is connected to purge gas supply device (not illustrated) provided outside the cryopump 10. Purge gas is supplied to the cryopump container 16 when the purge valve 20 is opened through control by the controller 46. The purge gas supply to the cryopump container 16 is cut off when the purge valve 20 is closed. The purge gas may be, for example, a nitrogen gas or other dry gases. The temperature of the purge gas may be adjusted, for example, to the room temperature, or may be heated to a temperature higher than the room temperature. By opening the purge valve 20 and introducing the purge gas into the cryopump container 16, the cryopump 10 can be pressurized. In addition, the temperature of the cryopump 10 can be increased from the cryogenic temperature to the room temperature or a temperature higher than the room temperature.

The vent valve 22 is provided at an exhaust line 50 to be described later, or may be provided at the cryopump container 16, for example, the cryocooler accommodating tube 16*b*. The vent valve 22 is provided in order to exhaust a fluid from the inside to the outside of the cryopump 10. The vent valve 22 may be connected to a storage tank (not illustrated) outside the cryopump 10, which receives the exhausted fluid. Alternatively, in a case where the exhausted fluid is harmless, the vent valve 22 may be configured to exhaust the exhausted fluid to the ambient environment. The fluid exhausted from the vent valve 22 is basically a gas, but may be a liquid or a mixture of a gas and a liquid.

The vent valve 22 is opened and closed in accordance with a command signal input from the controller 46. The vent valve 22 is opened by the controller 46 when exhausting a fluid from the cryopump container 16 such as during regeneration. When the fluid is not to be exhausted, the vent valve 22 is closed by the controller 46. The vent valve 22 may be, for example, a normally closed control valve. In addition, the vent valve 22 is configured to function as a so-called safety valve mechanically opened when a predetermined differential pressure is applied. For this reason, the vent valve 22 is mechanically opened without requiring control when the inside of the cryopump has become high-pressure for some reason. Accordingly, the high pressure therein can be released.

In addition, the cryopump 10 includes the exhaust line 50 including a plurality of exhaust passages, specifically, a first exhaust passage 51 and a second exhaust passage 52. The first exhaust passage 51 includes a first exhaust port 53 provided in the container body 16*a*, the second exhaust passage 52 includes a second exhaust port 54 provided in the cryocooler accommodating tube 16*b*. The first exhaust passage 51 is disposed outside the cryopump container 16, and connects the first exhaust port 53 to the vent valve 22. Similarly, the second exhaust passage 52 is disposed outside the cryopump container 16, and connects the second exhaust port 54 to the vent valve 22. The second exhaust passage 52 merges with the first exhaust passage 51 between the first exhaust port 53 and the vent valve 22.

The switching control valve 24 that opens and closes the second exhaust passage 52 is provided at the cryocooler accommodating tube 16*b* of the cryopump container 16. The switching control valve 24 is provided at the second exhaust passage 52 between a merging portion 55 of the first exhaust passage 51 and the second exhaust passage 52 and the second exhaust port 54. The switching control valve 24 is, for example, an opening and closing valve, or may be, for example, a solenoid valve. Similar to the vent valve 22, the switching control valve 24 is opened and closed in accordance with a command signal input from the controller 46. The switching control valve 24 is opened by the controller 46 when exhausting a fluid from the cryopump container 16, and is closed by the controller 46 when the fluid is not to be exhausted. As will be described later, the switching control valve 24 may be operable to close the second exhaust passage 52 when purge gas is supplied from the purge valve 20. The switching control valve 24 does not open and close the first exhaust passage 51. Fluid exhaust from the first exhaust port 53 to the vent valve 22 through the first exhaust passage 51 is allowed regardless of opening and closing of the switching control valve 24.

The first exhaust port 53 includes a through-hole formed in the container body 16*a* as an outlet for a fluid from the container body 16*a*, and is provided in the bottom portion of the container body 16*a* in the embodiment. For this reason, the first exhaust passage 51 is provided to be positioned below the cryocooler accommodating tube 16*b* when the cryopump 10 is disposed with the cryopump intake port 17 facing upward (that is, in a case of horizontal disposition).

In addition, in order to promote heat exchange between the radiation shield 36 or the cryopanel 38 and purge gas, the first exhaust port 53 may be provided in a part of the cryopump container 16, which is separated from the purge valve 20 as far as possible. Since the purge valve 20 is provided at the cryocooler accommodating tube 16*b* in the embodiment, the first exhaust port 53 may be provided, for example, on an opposite side of the container body 16*a* to the cryocooler accommodating tube 16*b*.

The first exhaust passage 51 may include a flexible pipe 56 that connects the first exhaust port 53 to the merging portion 55. If necessary, heating equipment such as an electric heater may be attached to the flexible pipe 56, or the flexible pipe may be covered with a heat insulating material. Alternatively, the first exhaust passage 51 may be configured by a rigid pipe. Similarly, the second exhaust passage 52 may include a flexible pipe or a rigid pipe, or may include heating equipment if necessary or be covered with a heat insulating material.

The second exhaust port 54 includes a through-hole as an outlet for a fluid from the cryocooler accommodating tube 16*b*, which is formed in the cryocooler accommodating tube 16*b*. In the embodiment, the second exhaust port is provided in the cryocooler accommodating tube 16*b* to be closer to the other end of the cryocooler accommodating tube 16*b*, which is fixed to the room temperature portion 26 of the cryocooler 14, than one end of the cryocooler accommodating tube 16*b*, which is coupled to the container body 16*a*.

As an exhaust operation of the cryopump 10 is continued, a gas accumulates in the cryopump 10. In order to exhaust the accumulated gas to the outside, the regeneration of the cryopump 10 is performed. The regeneration of the cryopump 10 generally includes a temperature increasing process, a exhausting process, and a cooling down process.

The temperature increasing process includes increasing the temperature of the cryopump 10 to a melting point of a target gas, among gases captured in the cryopump 10, or a temperature exceeding the melting point and further increasing the temperature of the cryopump 10 to a regeneration temperature. The target gas is, for example, a type 2 gas (for example, argon), and the melting point of the target gas is, for example, 100 K or lower. The regeneration temperature is, for example, the room temperature or a temperature higher than the room temperature.

A heat source for a temperature increase is, for example, the cryocooler 14. The cryocooler 14 enables a temperature increasing operation (a so-called reverse temperature increase). That is, the cryocooler 14 is configured such that adiabatic compression occurs in a working gas when the drive mechanism provided in the room temperature portion 26 operates in a reverse direction to a cooling operation. With compression heat obtained in this manner, the cryocooler 14 heats the first cooling stage 30 and the second cooling stage 34. The radiation shield 36 and the cryopanel 38 are heated with the first cooling stage 30 and the second cooling stage 34 as heat sources, respectively. In addition, also purge gas supplied from the purge valve 20 into the cryopump container 16 contributes to increasing the temperature of the cryopump 10. Alternatively, a heating device such as an electric heater may be provided in the cryopump 10. For example, an electric heater that can be controlled independently of the operation of the cryocooler 14 may be mounted on the first cooling stage 30 and/or the second cooling stage 34 of the cryocooler 14.

In the exhausting process, a gas captured in the cryopump 10 is revaporized or liquefied, and is exhausted as a gas, a liquid, or a mixture of a gas and a liquid through the exhaust line 50 or through the rough valve 18. As will be described later, the exhausting process includes exhausting a liquefied product of a target gas to the vent valve 22 from the container body 16*a* of the cryopump container 16 through the first exhaust passage 51 and/or from the cryocooler accommodating tube 16*b* of the cryopump container 16 through the second exhaust passage 52. In the cooling down process, the cryopump 10 is recooled to a cryogenic temperature for the vacuum pumping operation. When the regeneration is completed, the cryopump 10 can start the exhaust operation again.

Figure 3:
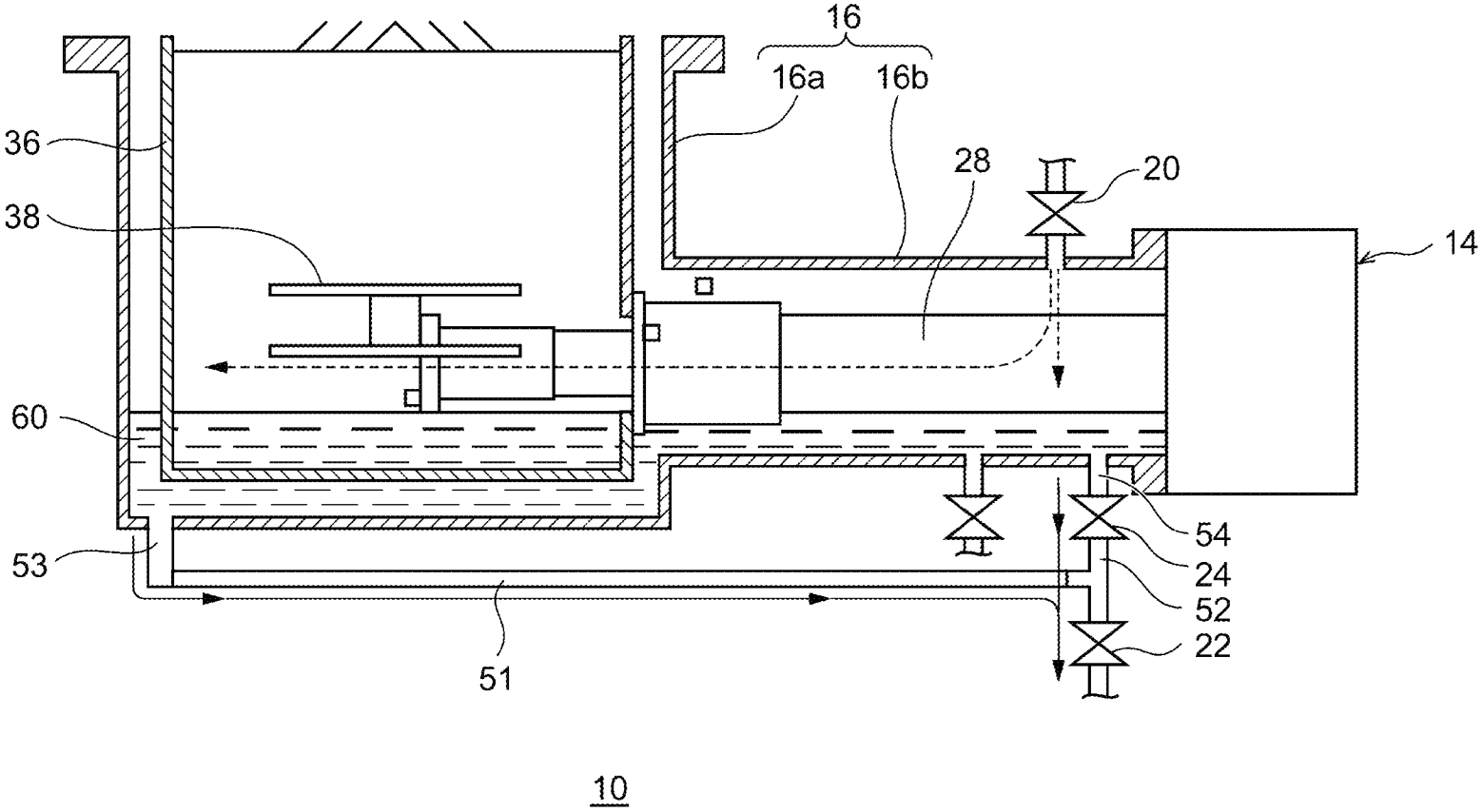
FIG. 3 is a view schematically illustrating an operation of the cryopump in a case where the cryopump according to the embodiment is horizontally disposed.
Figure 4:
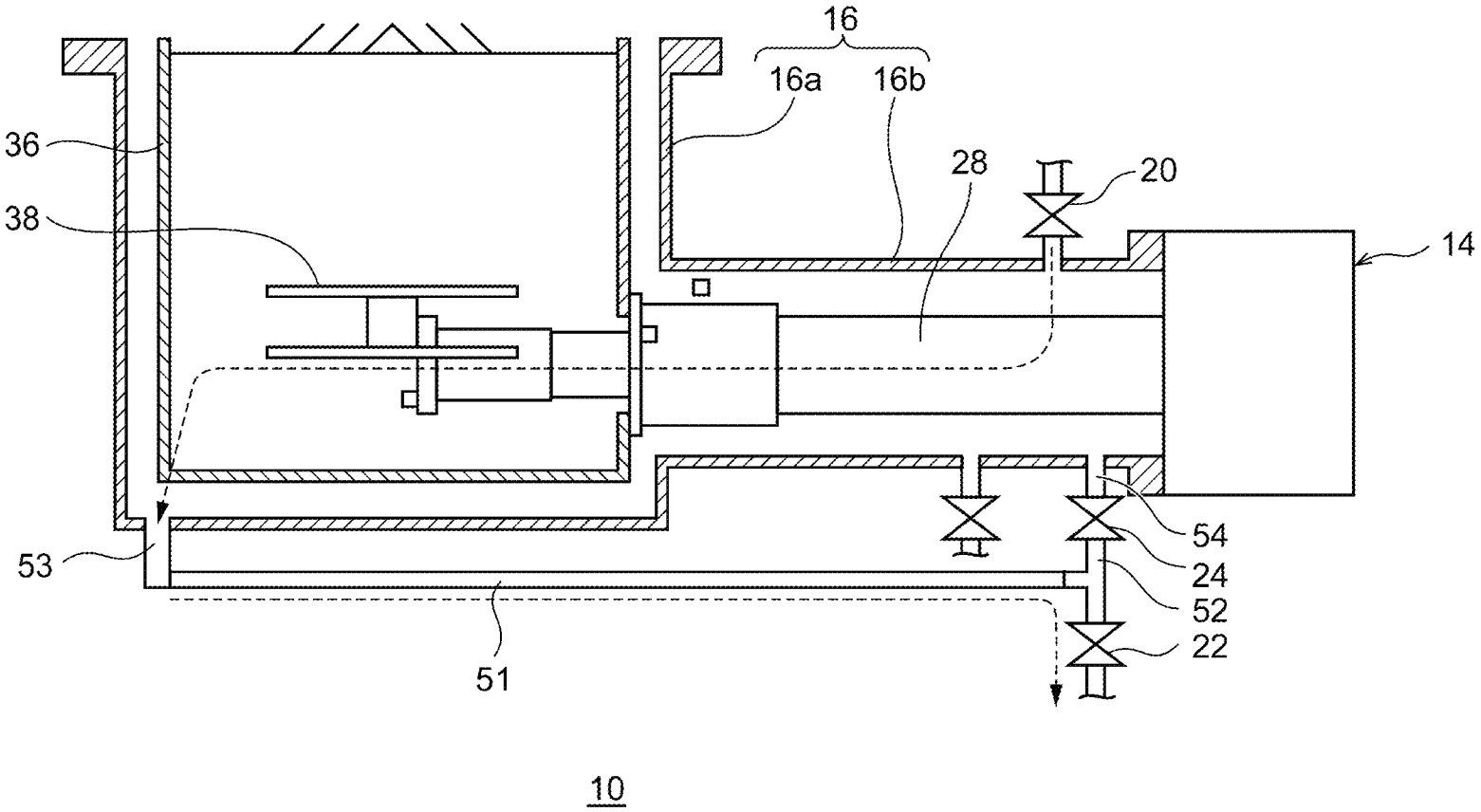
FIG. 4 is a view schematically illustrating the operation of the cryopump in a case where the cryopump according to the embodiment is horizontally disposed.

FIGS. 3 and 4 schematically illustrate an operation of cryopump 10 in a case where the cryopump 10 according to the embodiment is horizontally disposed. In FIGS. 3 and 4, fluid exhaust from the cryopump 10 during regeneration is indicated by a solid line arrow, and supply of purge gas to the cryopump 10 is indicated by a dashed line arrow.

Depending on a process to which the cryopump 10 is applied, a large amount of a so-called type 2 gas is accumulated in the cryopump 10 in some cases. For example, argon gas is used in the sputtering device as a process gas in some cases, and a large amount of the argon gas can be accumulated in the cryopump 10. Due to the temperature increase of the cryopump 10 during regeneration, a large amount of the accumulated argon gas is liquefied and temporarily accumulates inside the cryopump 10 in some cases. As illustrated in FIG. 3, in a case where the cryopump 10 is horizontally disposed, a liquefied product 60 of a type 2 gas, such as argon gas, flows downward due to gravity, and can accumulate in the bottom portion of the container body 16*a* and a lower portion of the cryocooler accommodating tube 16*b*.

In a case where there is the liquefied product 60 of the gas in the cryopump container 16 as described above, the switching control valve 24 and the vent valve 22 are opened by the controller 46. The liquefied product 60 accumulated in the bottom portion of the container body 16*a* is exhausted from the first exhaust port 53 to the vent valve 22 through the first exhaust passage 51. Since the switching control valve 24 is open, the liquefied product 60 accumulated in the lower portion of the cryocooler accommodating tube 16*b* is exhausted from the second exhaust port 54 to the vent valve 22 through the second exhaust passage 52. As indicated by the solid line arrow in FIG. 3, in this manner, the liquefied product 60 of the gas in the cryopump container 16 can be exhausted to the outside of the cryopump 10 from both of the first exhaust passage 51 and the second exhaust passage 52.

However, in the existing cryopump, the first exhaust port 53 is typically not provided in the cryopump container, and the vent valve is directly provided at the cryocooler accommodating tube. In such an existing cryopump, in the case of the horizontal disposition, the liquefied product of the gas accumulated in the lower portion of the cryocooler accommodating tube can be exhausted to the vent valve, but the liquefied product accumulated in the bottom portion of the container body needs to be vaporized and exhausted. The larger the cryopump, the larger the amount of the liquefied product accumulated in the bottom port ion of the container body.

Since it takes a considerable amount of time to vaporize a large amount of the liquefied product, temperature increasing time or regeneration time of the cryopump becomes longer. In addition, the liquefied product has an extremely low temperature (for example, liquefied argon can be approximately 80 K), and can cool a part (for example, the radiation shield and the first cylinder of the cryocooler) that is in contact therewith in the cryopump to a temperature lower than a temperature during the vacuum pumping operation. Accordingly, temperature increasing time of the cryopump becomes longer. In addition, in a case where the first cylinder is excessively cooled by the liquefied product, due to the subsequent heat shrinkage of the first cylinder, clearances with the displacers reciprocating in the cylinder may be narrowed (or eliminated). Then, in a case of the operation (that is, a reverse temperature increase) of the cryocooler during regeneration, a load of the motor driving the cryocooler increases, causing a failure of the cryocooler in the worst case.

In addition, there is also inconvenience that dew condensation occurs on a cryopump outer surface when the cryopump container is cooled through contact with the liquefied product. The longer the liquefied product stays in the cryopump container, the larger the amount of dew condensation.

On the other hand, in the embodiment, the first exhaust port 53 is provided in the bottom portion of the container body 16*a*, and the first exhaust passage 51 is provided to be positioned below the cryocooler accommodating tube 16*b* when the cryopump 10 is horizontally disposed. For this reason, after the liquefied product 60 is exhausted from the cryocooler accommodating tube 16*b* through the second exhaust passage 52, the liquefied product 60 accumulated in the bottom portion of the container body 16*a* can be exhausted from the first exhaust port 53 through the first exhaust passage 51. Since the liquefied product 60 can be quickly exhausted from the cryopump container 16 to the outside in this manner, the temperature increasing time described above and the amount of dew condensation can be prevented from increasing.

As indicated by the dashed line arrow in the FIG. 3, purge gas may be supplied from the purge valve 20 into the cryopump container 16. The liquefied product 60 can be heated and vaporized by the purge gas. In addition, by pushing the liquefied product 60 out to the first exhaust port 53 and the second exhaust port 54 with the pressure of the purge gas, the exhaust of the liquefied product 60 can be promoted.

Further, since the purge valve 20 at provided at the cryocooler accommodating tube 16*b* in the embodiment, purge gas can be directly blown from the purge valve 20 to the first cylinder 28. Since the purge gas has the room temperature or a temperature higher than the room temperature, the purge gas can heat the first cylinder 28, and can prevent the first cylinder 28 from being cooled by the liquefied product 60. The heating of the first cylinder 28 by such purge gas is particularly useful in a case where heating equipment such as an electric heater is not provided in the cryocooler 14.

In addition to heating the first cylinder 28, it is desired that the original role of the purge gas is to exchange heat also with the cryopanel 38 and the radiation shield 36 in the container body 16*a* so that the temperature thereof is rapidly increased. However, in a case where the purge valve 20 is provided at the cryocooler accommodating tube 16*b*, there is concern that most of the purge gas is exhausted from the second exhaust port 54 close to the purge valve 20 so that the purge gas is not spread so much in the container body 16*a*, and temperature increasing action for the cryopanel 38 or the radiation shield 36 by the purge gas is weakened. This may also inconveniently lead to an increase in regeneration time.

Thus, in the embodiment, a regeneration method may include exhausting purge gas from an exhaust port, among the first exhaust port 53 and the second exhaust port 54, which is farther from the purge valve 20, in a state where an exhaust port, among the first exhaust port 53 and the second exhaust port 54, which is closer to the purge valve 20, is closed when the purge gas is supplied from the purge valve 20 to the cryopump container 16.

Specifically, as illustrated in FIG. 4, after the liquefied product 60 is exhausted from the cryopump container 16, the switching control valve 24 is closed by the controller 46. Accordingly, purge gas supplied from the purge valve 20 passes through the container body 16*a* from the cryocooler accommodating tube 16*b*, heats the cryopanel 38 or the radiation shield 36 through heat exchange, and is exhausted from the first exhaust port 53. Accordingly, the inconvenience described above is avoided.

In a case where the amount of a type 2 gas accumulated in the cryopump 10 is sufficiently small and the liquefied product 60 is substantially not generated in the cryopump container 16 during regeneration, it is not necessary to open the switching control valve 24 during regeneration.

Figure 5:
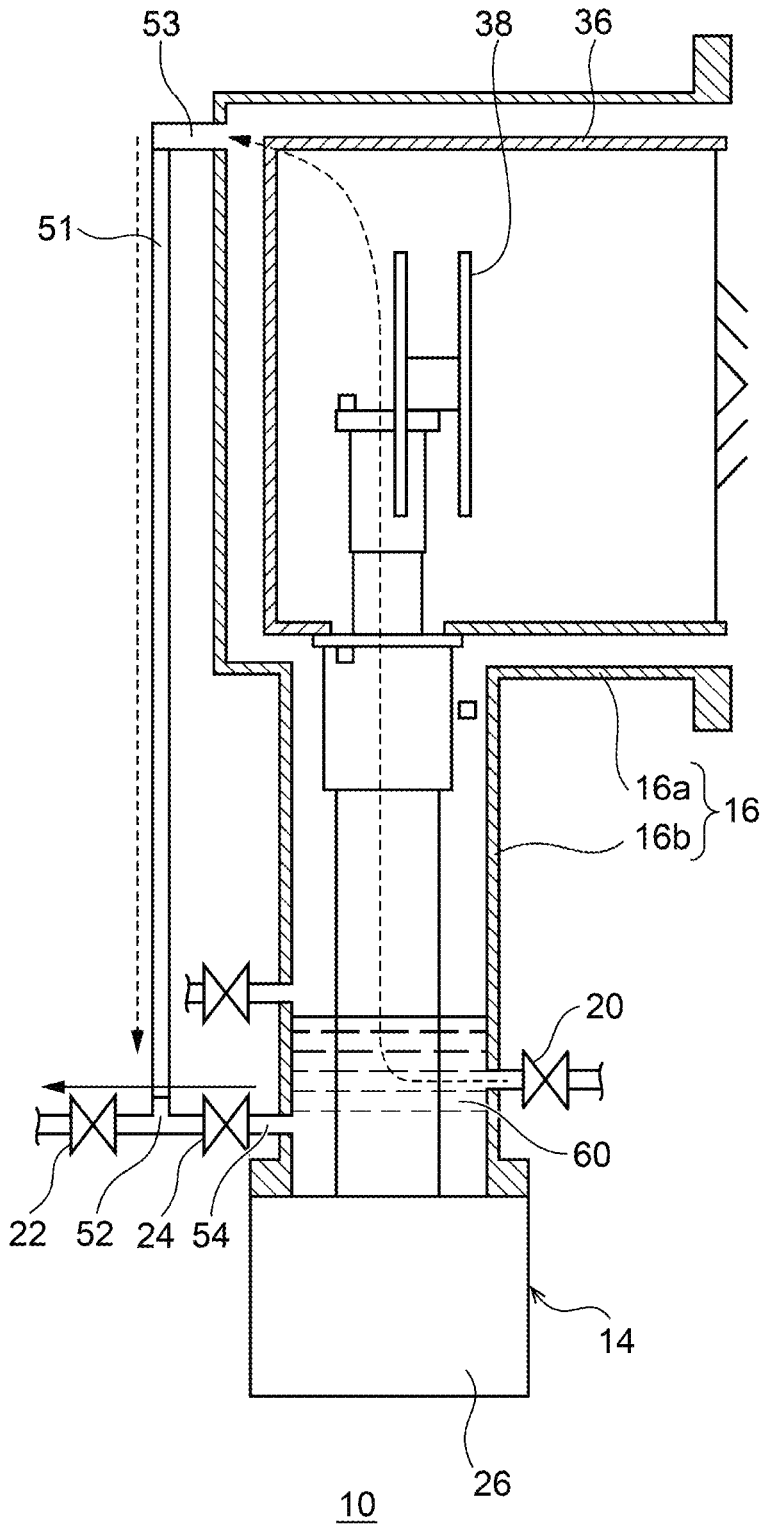
FIG. 5 is a view schematically illustrating an operation of the cryopump in a case where the cryopump according to the embodiment is vertically disposed.
Figure 6:
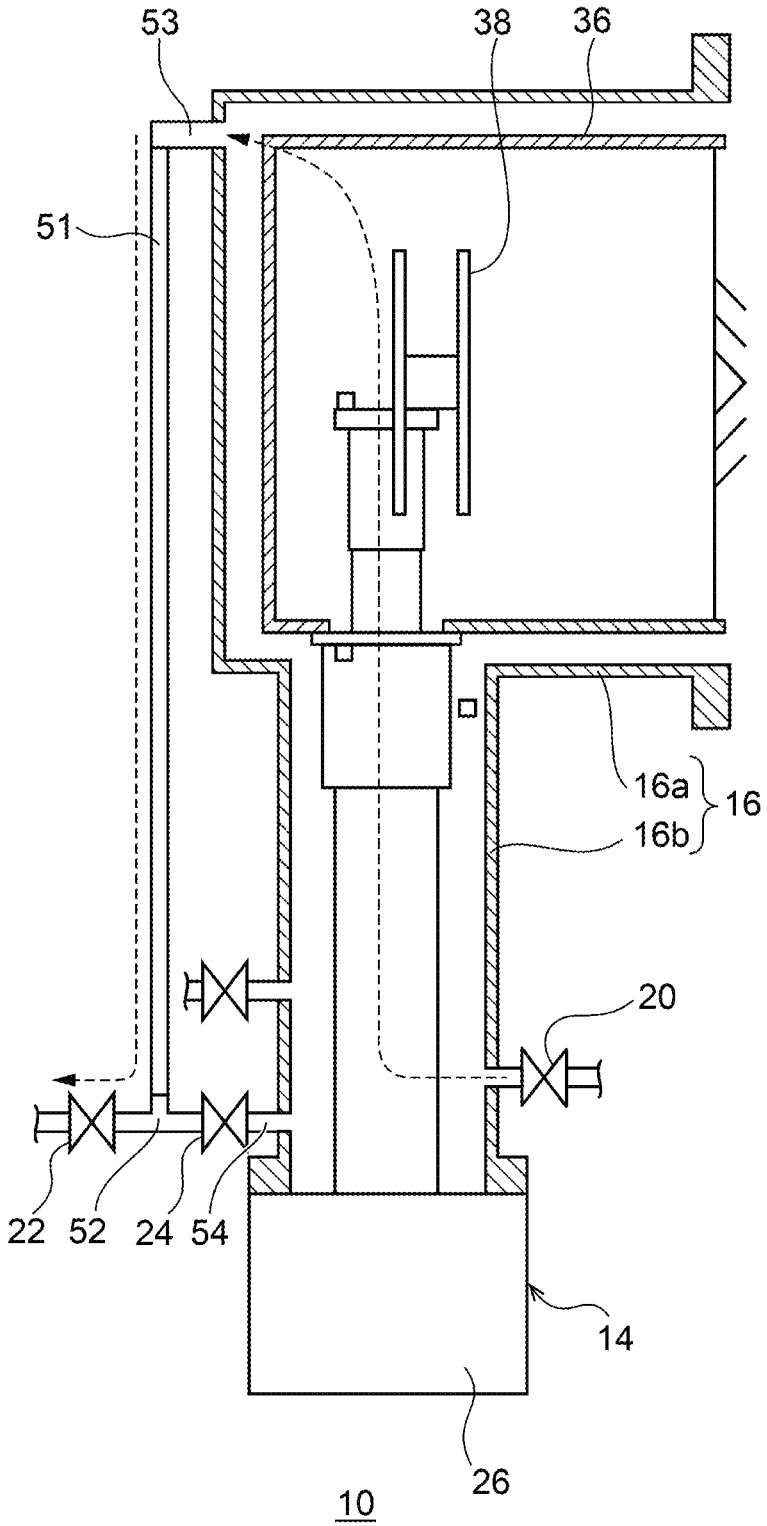
FIG. 6 is a view schematically illustrating the operation of the cryopump in a case where the cryopump according to the embodiment is vertically disposed.

FIGS. 5 and 6 schematically illustrate an operation of cryopump 10 in a case where the cryopump 10 according to the embodiment is vertically disposed. As illustrated in FIGS. 5 and 6, the cryopump 10 can be vertically disposed, that is, provided such that the container body 16*a* is positioned above and the room temperature portion 26 of the cryocooler 14 is positioned below. In this case, the cryocooler 14 extends in a vertical direction. In FIGS. 5 and 6, fluid exhaust from the cryopump 10 during regeneration is indicated by a solid line arrow, and supply of purge gas to the cryopump 10 is indicated by a dashed line arrow.

As illustrated in FIG. 5, when the temperature of the cryopump 10 is increased through regeneration, in the case of the vertical disposition, the liquefied product 60 of the gas flows downward due to gravity, and can accumulate in a bottom portion of the cryocooler accommodating tube 16*b* (a room temperature portion 26 side of the cryocooler 14).

In a case where there is the liquefied product 60 in the cryopump container 16, the switching control valve 24 and the vent valve 22 are opened by the controller 46. Since the switching control valve 24 is open, the liquefied product 60 accumulated in the bottom portion of the cryocooler accommodating tube 16*b* is exhausted from the second exhaust port 54 to the vent valve 22 through the second exhaust passage 52. In this manner, as indicated by the solid line arrow in FIG. 5, the liquefied product 60 of the gas in the cryopump container 16 can be exhausted to the outside of the cryopump 10. In this case, as indicated by the dashed line arrow in the FIG. 5, purge gas may be supplied from the purge valve 20 into the cryopump container 16. The purge gas is exhausted from the first exhaust port 53 to the vent valve 22 through the first exhaust passage 51. Similar to the case of the horizontal disposition, the liquefied product 60 can be quickly exhausted from the cryopump container 16 to the outside in this manner, and the temperature increasing time described above and the amount of dew condensation can be prevented from increasing.

In the embodiment, the second exhaust port 54 is provided in the cryocooler accommodating tube 16*b* to be closer to the other end of the cryocooler accommodating tube 16*b*, which is fixed to the cryocooler 14, than one end of the cryocooler accommodating tube 16*b*, which is coupled to the container body 16*a*. That is, the second exhaust port 54 is provided to be close to the room temperature portion 26 of the cryocooler 14. For this reason, a larger amount of the liquefied product 60 can be exhausted from the bottom portion of the cryocooler accommodating tube 16*b*.

As illustrated in FIG. 6, after the liquefied product 60 is exhausted from the cryopump container 16, the switching control valve 24 is closed by the controller 46. Accordingly, purge gas supplied from the purge valve 20 passes through the container body 16*a* from the cryocooler accommodating tube 16*b*, heats the cryopanel 38 or the radiation shield 36 through heat exchange, and is exhausted from the first exhaust port 53. Accordingly, the inconvenience caused by exhausting the purge gas from the purge valve 20 to the second exhaust port 54 without passing through the container body 16*a* is avoided.

Figure 7:
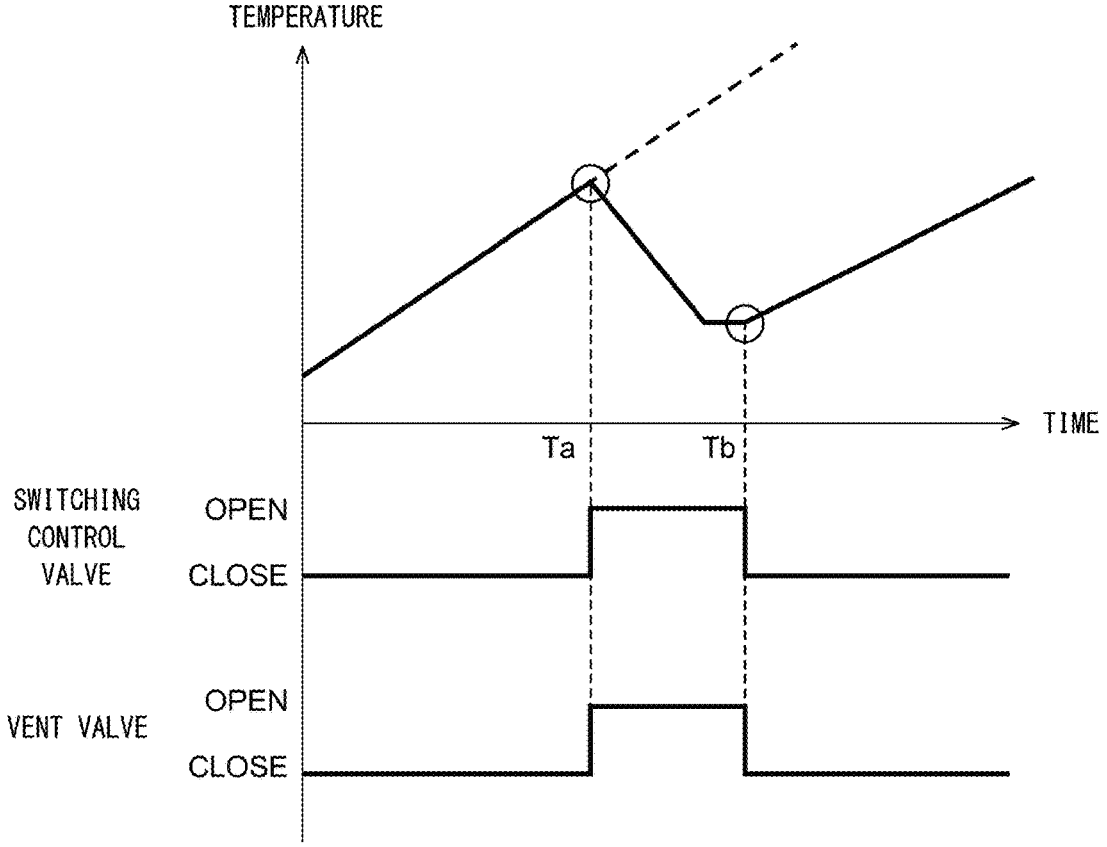
FIG. 7 is a graph schematically showing a regeneration method of the cryopump according to the embodiment.
Figure 8:
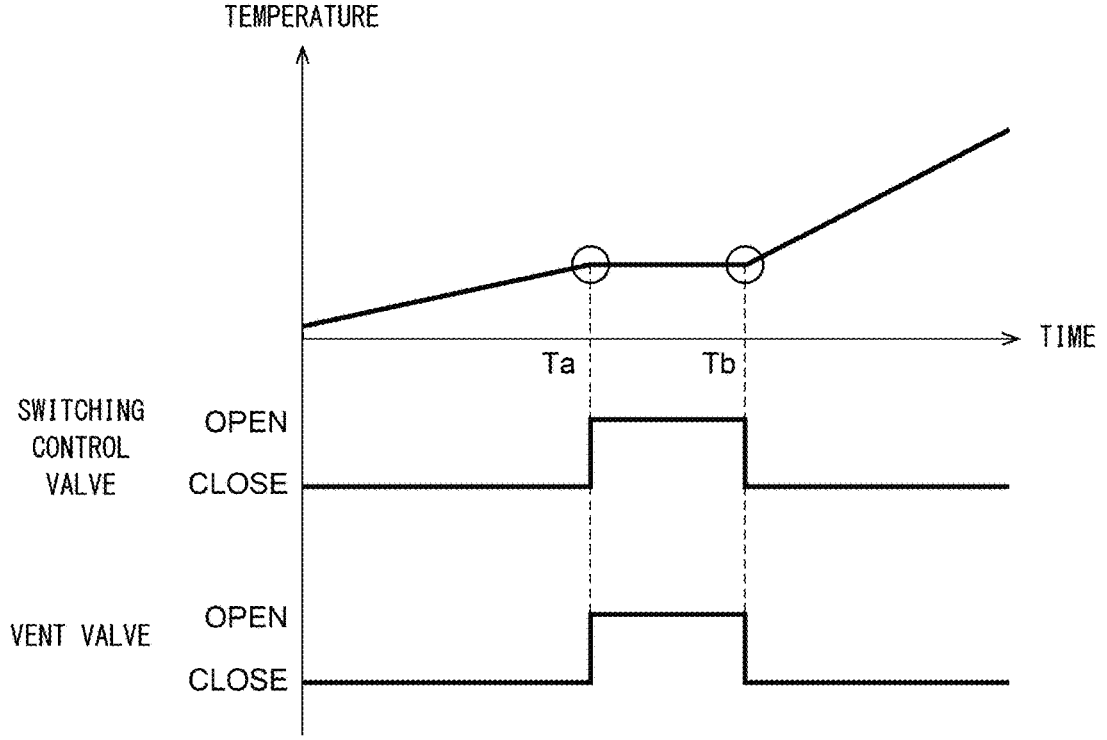
FIG. 8 is a graph schematically showing the regeneration method of the cryopump according to the embodiment.

FIGS. 7 and 8 are graphs schematically showing the regeneration method of the cryopump 10 according to the embodiment. FIG. 7 shows a temperature measured by the first temperature sensor 40 in the temperature increasing process during regeneration together with opening and closing timings of the switching control valve 24 and the vent valve 22. FIG. 8 shows a temperature measured by the second temperature sensor 42 in the temperature increasing process during regeneration together with the opening and closing timings of the switching control valve 24 and the vent valve 22.

As shown in FIG. 7, when regeneration is started, the temperature of the cryopump 10 is increased, and the measured temperature from the first temperature sensor 40 increases. A type 2 gas such as argon gas condensed on the surface of the cryopanel 38 melts. The type 2 gas liquefied in this manner can accumulate in a bottom portion of the cryopump container 16.

The accumulated liquefied gas can come into contact with parts of the cryopump 10 cooled by the first cooling stage 30, such as the radiation shield 36 and the first cylinder 28. Since the temperature of the liquefied gas is lower than the parts, the radiation shield 36 and the first cylinder 28 are cooled by the liquefied gas. For this reason, a change in the measured temperature from the first temperature sensor 40 is converted from an increase to a decrease (a timing Ta of FIG. 7).

The controller 46 receives a measurement signal indicating a measured temperature from the first temperature sensor 40, detects conversion f roman increase to a decrease in the measured temperature based on the measurement signal, and controls the switching control valve 24 so that the second exhaust passage 52 is opened according to the conversion. That is, the switching control valve 24 is opened at the timing Ta. Simultaneously, the controller 46 also opens the vent valve 22.

In this manner, a liquefied gas is exhausted from the cryopump container 16 through the first exhaust passage 51 and the second exhaust passage 52. When the exhaust of the liquefied gas is completed, a measured temperature from the first temperature sensor 40 starts to increase again (a timing Tb of FIG. 7).

The controller 46 receives a measurement signal indicating a measured temperature from the first temperature sensor 40, detects reconversion from a decrease to an increase in the measured temperature based on the measurement signal, and controls the switching control valve 24 so that the second exhaust passage 52 is closed according to the reconversion. That is, the switching control valve 24 is closed at the timing Tb. Simultaneously, the controller 46 also closes the vent valve 22. After then, the temperature of the cryopump 10 is further increased toward the regeneration temperature.

In a case where the amount of a type 2 gas accumulated in the cryopump 10 is sufficiently small and a liquefied gas is not accumulated in the cryopump container 16 or the generated liquefied gas is quickly vaporized, a measured temperature from the first temperature sensor 40 simply increases as indicated by a dashed line in FIG. 7. The measured temperature is not converted from an increase to a decrease. Therefore, the controller 46 does not open the switching control valve 24 and the vent valve 22.

In addition, as shown in FIG. 8, when regeneration is started, a measured temperature from the second temperature sensor 42 also increases. In a case where a liquefied type 2 gas is accumulated in the bottom portion of the cryopump container 16, the liquefied gas can come into contact with parts of the cryopump 10 cooled by the second cooling stage 34, such as the cryopanel 38. Since the parts and the liquefied gas have substantially the same temperature, the measured temperature from the second temperature sensor 42 stops increasing (the timing Ta of FIG. 8).

Accordingly, the controller 46 may control the switching control valve 24 and the vent valve 22 based on the measured temperature from the second temperature sensor 42. The controller 46 may receive a measurement signal indicating the measured temperature from the second temperature sensor 42, detect the stop of an increase in the measured temperature based on the measurement signal, and control the switching control valve 24 so that the second exhaust passage 52 is opened according to the stop. That is, the switching control valve 24 is opened at the timing Ta. Simultaneously, the controller 46 may also open the vent valve 22.

When the exhaust of the liquefied gas is completed, the measured temperature from the second temperature sensor 42 starts to increase again (the timing Tb of FIG. 8). The controller 46 may receive the measurement signal indicating the measured temperature from the second temperature sensor 42, detect the resumption of an increase in the measured temperature based on the measurement signal, and control the switching control valve 24 so that the second exhaust passage 52 is closed according to the resumption. The switching control valve 24 is closed at the timing Tb. Simultaneously, the controller 46 may also close the vent valve 22.

It is possible to set, as appropriate, a threshold for detecting conversion from an increase to a decrease in a measured temperature or stop of the increase or a threshold for detecting reconversion from a decrease to an increase in the measured temperature or resumption of the increase based on empirical knowledge of a designer or experiments and simulations by the designer.

It is preferable to close the switching control valve 24 and the vent valve 22 at the time of regeneration start. This is because there is a possibility that the inside of the cryopump container 16 is under a negative pressure at the time of regeneration start, and a risk of generating backflow into the cryopump container 16 is reduced. Alternatively, the controller 46 may receive a measurement signal indicating a measured pressure from the pressure sensor 44, and open the switching control valve 24 and the vent valve 22 based on the measurement signal when the measured pressure is the atmospheric pressure.

In the embodiment, without restricting a provision posture among various provision postures that can be taken at the site where the cryopump 10 is used, a liquefied product of a gas can be quickly exhausted to the outside through any one of the plurality of exhaust ports. For example, in a case where the cryopump 10 is horizontally disposed, the liquefied product can be exhausted from the bottom portion of the container body 16*a* through the first exhaust port 53 and from the cryocooler accommodating tube 16*b* through the second exhaust port 54. In the case of vertical disposition, the liquefied product can be exhausted from the cryocooler accommodating tube 16*b* through the second exhaust port 54. In the case of other provision postures, similarly, the liquefied product can be exhausted through the first exhaust port 53 and/or the second exhaust port 54. By quickly exhausting the liquefied product of the gas from the cryopump 10, temperature increasing time or regeneration time of the cryopump 10 can be shortened. In addition, dew condensation on the outer surface of the cryopump 10 caused by the liquefied product can also be reduced.

The present invention has been described hereinbefore based on the examples. It is clear for those skilled in the art that the present invention is not limited to the embodiment, various design changes are possible, various modification examples are possible, and such modification examples are also within the scope of the present invention.

Figure 9:
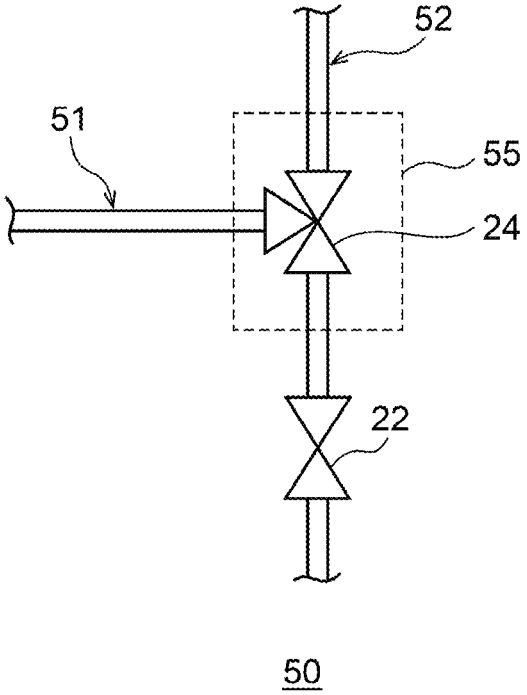
FIG. 9 schematically illustrates an exhaust line of a cryopump according to another embodiment.

FIG. 9 schematically illustrates the exhaust line 50 of the cryopump 10 according to another embodiment. As illustrated, the switching control valve 24 may be a three-way valve provided at the merging portion 55 of the first exhaust passage 51 and the second exhaust passage 52. In this case, the switching control valve 24 can alternately open and close the first exhaust passage 51 and the second exhaust passage 52. Even in this manner, a fluid can be exhausted to the vent valve 22 through the first exhaust passage 51 or through the second exhaust passage 52 of the exhaust line 50.

Although the purge valve 20 is provided at the cryocooler accommodating tube 16*b* in the embodiment described above, the purge valve 20 may be provided at another part of the cryopump container 16, for example, the container body 16*a*. In this case, the switching control valve 24 may be provided at the first exhaust passage 51, and the first exhaust passage 51 may be opened and closed. In this manner, purge gas from the exhaust port (that is, the second exhaust port 54) farther from the purge valve 20 can be exhausted in a state where the exhaust port (that is, the first exhaust port 53) closer to the purge valve 20 is closed when the purge gas is supplied from the purge valve 20 to the cryopump container 16.

Although the first exhaust passage 51 and the second exhaust passage 52 merge with one vent valve 22 in the embodiment described above, this is not essential. In one embodiment, a vent valve may be provided at each of the first exhaust passage 51 and the second exhaust passage 52.

Although the horizontal cryopump 10 is given as an example in the description, the present invention is also applicable to other vertical cryopumps. In the vertical cryopump 10, a cryocooler insertion port is provided in the bottom portion of the container body 16*a*, and the cryocooler accommodating tube 16*b* is coupled to the bottom portion of the container body 16*a* at the cryocooler insertion port. Similarly, adjacent to the cryocooler insertion port of the container body 16*a*, a hole passing through the cryocooler 14 is provided also in a bottom portion of the radiation shield 36. The second cylinder 32 and the second cooling stage 34 of the cryocooler 14 are inserted into the radiation shield 36 through the holes, and the radiation shield 36 is thermally coupled to the first cooling stage 30 around the holes in the side portions.

The embodiment of the present invention can also be expressed as follows.

1. A cryopump including:

a cryocooler;

a cryopanel cooled by the cryocooler;

a cryopump container that includes a container body which accommodates the cryopanel and a cryocooler accommodating tube of which one end is coupled to the container body and the other end is fixed to the cryocooler and into which the cryocooler is inserted;

a vent valve for exhausting a fluid from the cryopump container;

a first exhaust passage that includes a first exhaust port provided in the container body, is disposed outside the cryopump container, and connects the first exhaust port to the vent valve; and a second exhaust passage that includes a second exhaust port provided in the cryocooler accommodating tube, connects the second exhaust port to the vent valve, and merges with the first exhaust passage between the first exhaust port and the vent valve.

2. The cryopump according to Embodiment 1, in which the container body includes a cryopump intake port, and the cryocooler accommodating tube is coupled to a side portion of the container body, and the first exhaust port is provided in a bottom portion of the container body, and the first exhaust passage is provided to be positioned below the cryocooler accommodating tube when the cryopump is disposed with the cryopump intake port facing upward.

3. The cryopump according to Embodiment 1 or 2, in which the second exhaust port is provided in the cryocooler accommodating tube to be closer to the other end of the cryocooler accommodating tube, which is fixed to the cryocooler, than the one end of the cryocooler accommodating tube, which is coupled to the container body.

4. The cryopump according to any one of Embodiments 1 to 3, further including:

a purge valve that is provided at the cryocooler accommodating tube and is for supplying purge gas to the cryopump container; and a switching control valve that is provided at a merging portion of the first exhaust passage and the second exhaust passage or at the second exhaust passage between the merging portion and the second exhaust port and opens and closes at least the second exhaust passage.

5. The cryopump according to Embodiment 4, further including:

a temperature sensor that measures a temperature in the cryopump and outputs a measurement signal indicating a measured temperature; and a controller that detects conversion from an increase to a decrease in the measured temperature or stop of the increase based on the measurement signal and controls the switching control valve such that the second exhaust passage is opened according to the conversion or the stop.

6. The cryopump according to Embodiment 5, in which the controller detects reconversion from a decrease to an increase in the measured temperature or resumption of the increase based on the measurement signal and controls the switching control valve such that the second exhaust passage is closed according to the reconversion or the resumption.

7. A regeneration method of a cryopump, the method including:

increasing a temperature of the cryopump to a melting point of a target gas, among gases captured in the cryopump, or a temperature exceeding the melting point; and exhausting a liquefied product of the target gas to a vent valve from a container body of a cryopump container through a first exhaust passage and/or from a cryocooler accommodating tube of the cryopump container through a second exhaust passage, in which the first exhaust passage includes a first exhaust port provided in the container body and is disposed outside the cryopump container, and the second exhaust passage includes a second exhaust port provided in the cryocooler accommodating tube and merges with the first exhaust passage between the first exhaust port and the vent valve.

8. A cryopump including:

a cryocooler;

a cryopanel cooled by the cryocooler;

a cryopump container that includes a container body which accommodates the cryopanel and a cryocooler accommodating tube of which one end is coupled to the container body and the other end is fixed to the cryocooler and into which the cryocooler is inserted;

a purge valve that is provided at the cryocooler accommodating tube and is for supplying purge gas to the cryopump container; and a first exhaust passage that includes a first exhaust port provided in the container body;

a second exhaust passage that includes a second exhaust port provided in the cryocooler accommodating tube; and a switching control valve that is capable of closing the second exhaust passage when the purge gas is supplied from the purge valve.

9. A regeneration method of a cryopump, the method including:

increasing a temperature of the cryopump to a melting point of a target gas, among gases captured in the cryopump, or a temperature exceeding the melting point;

exhausting a liquefied product of the target gas to an outside of a cryopump container through a first exhaust port of a container body of the cryopump container and/or through a second exhaust port of a cryocooler accommodating tube of the cryopump container; and exhausting purge gas from an exhaust port, among the first exhaust port and the second exhaust port, which is farther from a purge valve, in a state where an exhaust port closer to the purge valve, among the first exhaust port and the second exhaust port, is closed when the purge gas is supplied from the purge valve to the cryopump container.

It should be understood that the invention is not limited to the above-described embodiment, but may be modified into various forms on the basis of the spirit of the invention. Additionally, the modifications are included in the scope of the invention.

What is claimed is:

1. A cryopump comprising:

a cryocooler;

a cryopanel that is cooled by the cryocooler;

a cryopump container that includes a container body, which accommodates the cryopanel, and a cryocooler accommodating tube of which one end is coupled to the container body and the other end is fixed to the cryocooler and into which the cryocooler is inserted;

a vent valve for exhausting a fluid from the cryopump container;

a first exhaust passage that includes a first exhaust port provided in the container body, is disposed outside the cryopump container, and connects the first exhaust port to the vent valve; and a second exhaust passage that includes a second exhaust port provided in the cryocooler accommodating tube, connects the second exhaust port to the vent valve, and merges with the first exhaust passage between the first exhaust port and the vent valve.

2. The cryopump according to claim 1, wherein the container body includes a cryopump intake port, and the cryocooler accommodating tube is coupled to a side portion of the container body, and the first exhaust port is provided in a bottom portion of the container body, and the first exhaust passage is provided to be positioned below the cryocooler accommodating tube when the cryopump is disposed with the cryopump intake port facing upward.

3. The cryopump according to claim 1, wherein the second exhaust port is provided in the cryocooler accommodating tube to be closer to the other end of the cryocooler accommodating tube, which is fixed to the cryocooler, than the one end of the cryocooler accommodating tube, which is coupled to the container body.

4. The cryopump according to claim 1, further comprising:

a purge valve that is provided at the cryocooler accommodating tube and is for supplying purge gas to the cryopump container; and a switching control valve that is provided at a merging portion of the first exhaust passage and the second exhaust passage or at the second exhaust passage between the merging portion and the second exhaust port and opens and closes at least the second exhaust passage.

5. The cryopump according to claim 4, further comprising:

a temperature sensor that measures a temperature in the cryopump and outputs a measurement signal indicating a measured temperature; and a controller that detects conversion from an increase to a decrease in the measured temperature or stop of the increase based on the measurement signal and controls the switching control valve such that the second exhaust passage is opened according to the conversion or the stop.

6. The cryopump according to claim 5, wherein the controller detects reconversion from a decrease to an increase in the measured temperature or resumption of the increase based on the measurement signal and controls the switching control valve such that the second exhaust passage is closed according to the reconversion or the resumption.

7. A regeneration method of a cryopump, the method comprising:

increasing a temperature of the cryopump to a melting point of a target gas, among gases captured in the cryopump, or a temperature exceeding the melting point; and exhausting a liquefied product of the target gas to a vent valve from one of three sources, the three sources including a first source associated with a container body of a cryopump container through a first exhaust passage, from a second source associated with a cryocooler accommodating tube of the cryopump container through a second exhaust passage, and a third source associated with a combination of the container body through the first exhaust passage and the cryocooler accommodating tube through the second exhaust passage, wherein the first exhaust passage includes a first exhaust port provided in the container body and is disposed outside the cryopump container, and the second exhaust passage includes a second exhaust port provided in the cryocooler accommodating tube and merges with the first exhaust passage between the first exhaust port and the vent valve.

8. A cryopump comprising:

a cryocooler;

a cryopanel that is cooled by the cryocooler;

a cryopump container that includes a container body, which accommodates the cryopanel, and a cryocooler accommodating tube of which one end is coupled to the container body and the other end is fixed to the cryocooler and into which the cryocooler is inserted;

a purge valve that is provided at the cryocooler accommodating tube and is for supplying purge gas to the cryopump container;

a first exhaust passage that includes a first exhaust port provided in the container body;

a second exhaust passage that includes a second exhaust port provided in the cryocooler accommodating tube; and a switching control valve that is capable of closing the second exhaust passage when the purge gas is supplied from the purge valve.

9. A regeneration method of a cryopump, the method comprising:

increasing a temperature of the cryopump to a melting point of a target gas, among gases captured in the cryopump, or a temperature exceeding the melting point;

exhausting a liquefied product of the target gas to an outside of a cryopump container through one of three exhaust ports, the three exhaust ports including a first exhaust port of a container body of the cryopump container, through a second exhaust port of a cryocooler accommodating tube of the cryopump container, and a third exhaust port that is a combination of the first exhaust port and the second exhaust port; and exhausting purge gas from an exhaust port, among the first exhaust port and the second exhaust port, which is farther from a purge valve, in a state where an exhaust port, among the first exhaust port and the second exhaust port, which is closer to the purge valve, is closed when the purge gas is supplied from the purge valve to the cryopump container.

* * * * *